United States Patent [19]

Baulard-Caugan

[11] 4,193,371

[45] Mar. 18, 1980

[54] DOUBLE-ACTING SINGLE-WEB SWIMMING APPARATUS

[76] Inventor: Raymond G. Baulard-Caugan, Résidence Dauphine Pavillon du Barry, Louveciennes, France, 78430

[21] Appl. No.: 839,501

[22] Filed: Oct. 5, 1977

[30] Foreign Application Priority Data

Oct. 5, 1976 [FR] France ..... 76 29926

[51] Int. Cl.[2] ..... B63H 16/00

[52] U.S. Cl. ..... 115/22.2; 115/28 R

[58] Field of Search ..... 9/301, 309; 115/28 R, 115/29, 30, 21, 22.1, 22.2, 22.3, 25, 26.1, 26.3

[56] References Cited

U.S. PATENT DOCUMENTS

| | | | |
|---|---|---|---|
| 2,854,787 | 10/1958 | Oberg | 115/28 R X |
| 3,377,977 | 4/1968 | Malm | 115/28 R |
| 3,380,426 | 4/1968 | Davies | 115/28 R |
| 3,426,722 | 2/1969 | Dragich | 115/28 R X |

FOREIGN PATENT DOCUMENTS

| | | | |
|---|---|---|---|
| 1332642 | 6/1963 | France | 9/301 |

*Primary Examiner*—Sherman D. Basinger
*Attorney, Agent, or Firm*—Steinberg and Blake

[57] ABSTRACT

A swimmer's propulsion apparatus of the type comprising an anti-drift member and a propelling fish-tail member connected to the anti-drift member so as to perform a swinging motion with respect to said anti-drift member, wherein the improvement consists in that the propelling member is arranged to substantially freely pivot within a predetermined neutral sector about a pivot bar oscillated by the swimmer and that the rear portion of the propelling member beyond said pivot bar has a surface greater than its front portion.

13 Claims, 13 Drawing Figures

DOUBLE-ACTING SINGLE-WEB SWIMMING APPARATUS

The present invention relates to an apparatus of improved and simple construction enabling a swimmer, even one having little experience, to move without tiring over very long distances and at a relatively important speed. The invention therefore applies, on the one hand, to the field of aquatic pleasures, but, on the other hand, offers new possibilities (owing to the speed which the apparatus can reach) to all rescuers, beach supervisors and the like.

Among all the apparatus that have been proposed to increase the swimmers' speed and save their energy, swimming apparatus have already been seen, which comprises a porpelling fish-tail member designed to be actuated by the swimmer in a reciprocating motion similar to that of a fish. It first had to be admitted that a simple rotary sweeping motion of the fish-tail produced only an inefficient stirring of the water behind the swimmer, resulting in a quite unsatisfactory propelling effect. By investigating the problem a little more closely and, probably by observing more accurately the motion of a fish-tail, it was realized that it was necessary for the propelling fish-tail member to present its own curvature during its reciprocating motion so as to drive the water as rearwards as possible (thus increasing the propelling component) rather than sidewise as was the case previously. Higher-performance apparatus therefore appeared, which used propelling members of flexible material capable of automatically bending in the desired direction during the stirring reciprocating motion. The apparatus thus obtained were really propulsive, but their efficiency remained poor owing to the major part of the swimmer's efforts being used to achieve the said bending of the propelling member. In other words, a great portion of the sweeping stroke of the fish-tail member was not used to drive the water towards the rear of the swimmer, resulting in a propulsive action on the latter, but only to curve the propelling member itself until it assumed its actually efficient shape. At each beat, during the period of time within which the flexible member was curved under the action of the resistance of the repelled water, the swimmer's efforts resulted in sidewise displacements of that water, which, in counter-reaction, subjected the swimmer to painful, tortional motions impairing the directivity or directional controllability of the apparatus.

The present invention provides a solution to this problem by allowing the propelling member to instantly assume a suitable position from the very beginning of even the smallest effort of the swimmer. The invention also provides a simpler and more sturdy structure by making it even unnecessary to use a propelling member made of a flexible material.

More specifically, the invention relates to an apparatus for the self-propulsion of swimmers, of the type comprising an anti-drift member, a harness set connected to the said anti-drift member and adapted to be passed around the swimmer's body and at least one propelling fish-tail member connected to the said anti-drift member by a transmission system so mounted as to perform a swinging or oscillating motion with respect to the said anti-drift member and to be actuated by the swimmer, characterized in that the said transmission system includes a first pivot bar substantially parallel to the medial main plane of the said anti-drift member, that the said propelling member is arranged to substantially freely pivot about the said first pivot bar lengthwise of the latter, that stop means are secured to the said transmission system and located on the pivoting path of the said propelling member about the said first pivot bar, so as to oppose its rotation, preferably beyond a predetermined neutral sector or angular area, and that the rear portion of the said propelling member, beyond the said first pivot bar, offers a larger surface at its front portion.

Thus, the additional degree of freedom (within a certain selected sector) of the propelling member with respect to the said transmission system allows the propelling member to pivot in one direction or the other form the outset of a sweeping travel until it meets the said stop means. It thus reaches a suitable position without the swimmer having to make an important effort to bring about this pivoting motion. The ratio of the surfaces of the propelling member on either side of the said pivot bar, if correctly selected, is sufficient to ensure the pivoting of the propelling member in the right direction at each beat.

The invention will be better understood and other purposes, details and advantages of the latter will appear more clearly from the following explanatory description of a preferred form of embodiment of an apparatus according to the invention, given solely by way of example with reference to the appended non-limitative drawings wherein.

Figure 1:
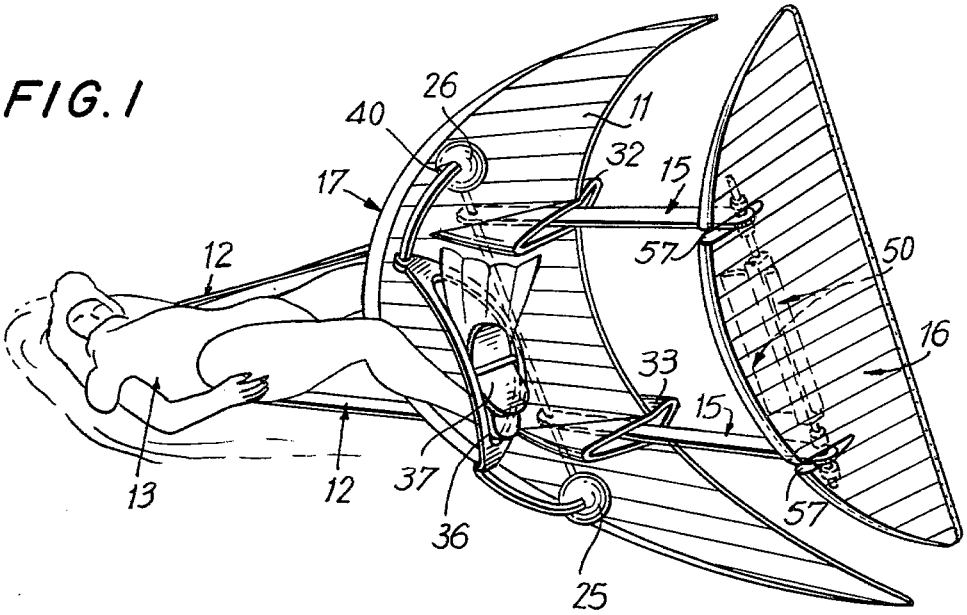
FIG. 1 is a general perspective view of the apparatus of the invention in use.
Figure 3:
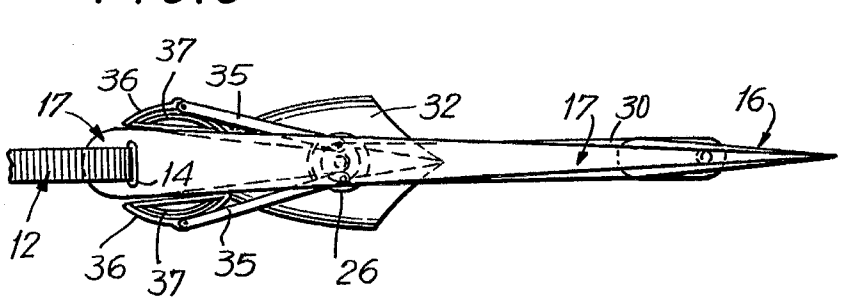
FIG. 3 is a top view of the apparatus shown in FIG. 2.
Figure 13:
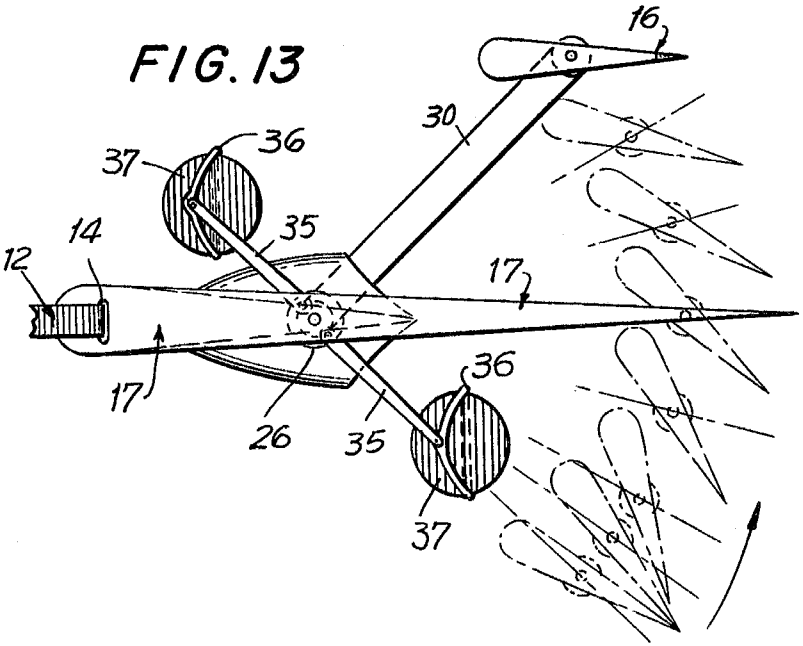
Figure 12:
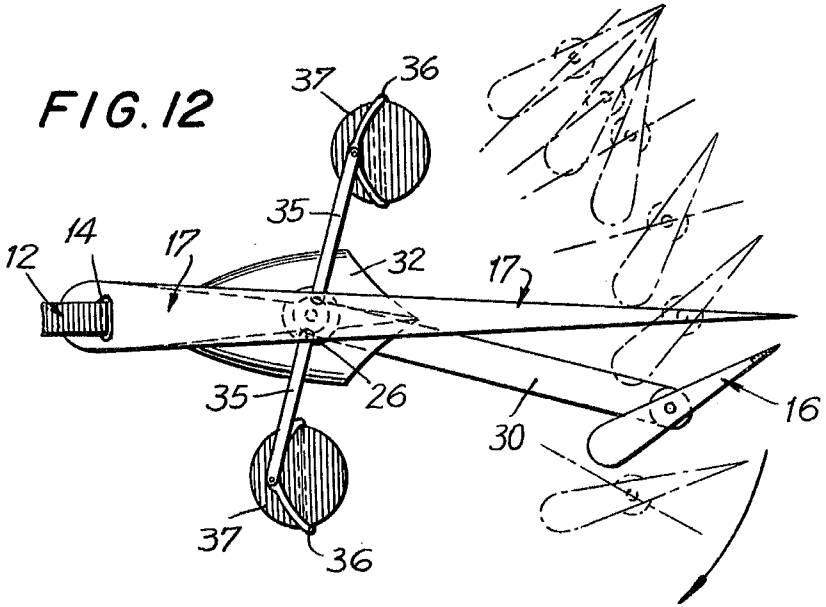
Figure 4:
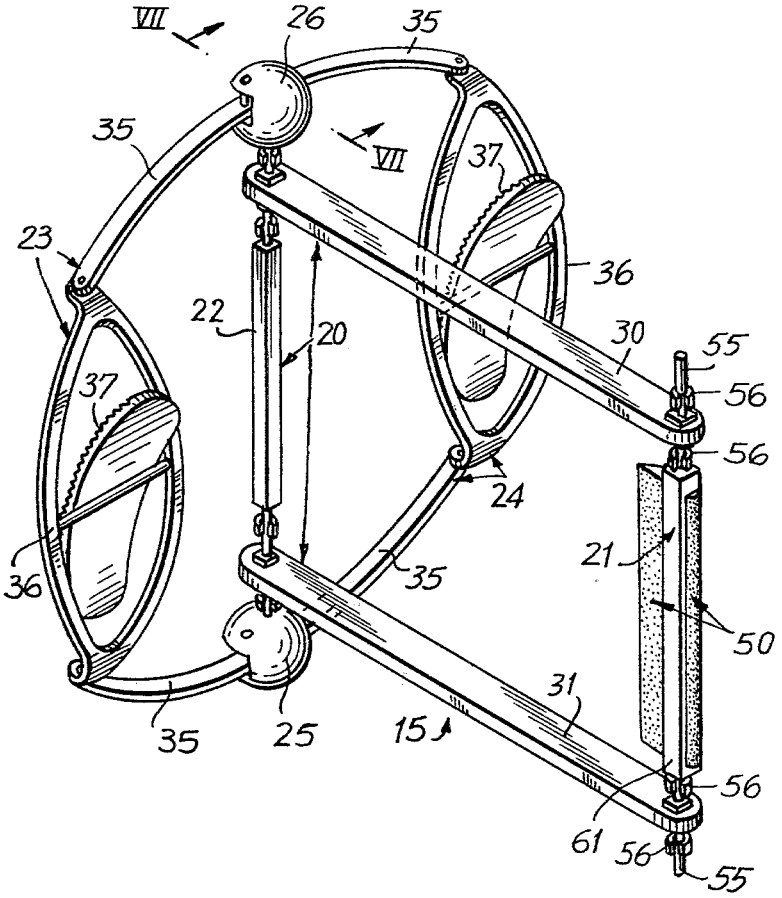
FIG. 4 is a detailed, general perspective view of the transmission system and the stop means.
Figure 9:
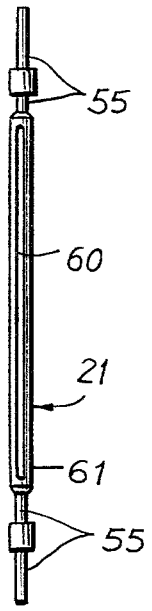
FIG. 9 is a detailed view of the said first pivot bar.

FIG. 12 is a top view of the apparatus, wherein the pedal means are in working position, the transmission system and the propelling member being shown in strong lines in the same position as in FIG. 1 and the trajectory of the said propelling member for a clockwise (on the drawing) sweeping motion, or a sweeping motion from the left to the right with respect to the swimmer, being symbolized by a series of intermediate positions of the said propelling member shown in thin lines; and FIG. 13 is a top view similar to that of FIG. 12, the transmission system and the propelling member being shown in strong lines at the end of an anti-clockwise (in the drawing) sweeping motion, or a sweeping motion from the right to the left with respect to the swimmer, the said sweeping motion being symbolized by a series of intermediate positions of the said propelling member shown in thin lines;

Referring to the drawings, it is seen that the apparatus according to the invention is constituted by an anti-drift member 11 to which is connected a harness set 12 passed round the shoulders of a swimmer 13 lying on the water astride and forward of the said anti-drift member as shown in FIG. 1. The harness set 12 is constituted by highly resistant bands, straps or the like capable of sliding through a substantially semicircular passage 14 provided within the core of the anti-drift member. The front portion of the latter may advantageously incorporate a ballasting section for adjusting the buoyancy of the apparatus. The anti-drift member is connected through a transmission system 15 to a propelling fish-tail member 16. The anti-drift member 11 is constituted by a kind of panel which is relatively flat but of rearwards tapering cross-section, as is shown in FIG. 3. It is generally crescent-shaped and its shaped leading or front edge 17 facing the swimmer and, as can be understood from the foregoing, constituting the thickest portion of the anti-drift member, is convex and, in particular hydro-dynamic or streamlined in section. It has been found that the shape of the anti-drift member 11 as just described, allows the lateral flapping of the anti-drift member to be kept within reasonable limits during use and even the residual flapping to be transformed into a substantially propulsive motion, thus additionally improving the efficiency of the apparatus as will be explained later. The anti-drift member 11 may be made for example of plastics material (thermoforming) and may consist of an assembly of two half-shells welded together edge to edge. The transmission system 15 clearly seen in FIG. 4 is composed of a rigid, undeformable frame 20 comprising two parallel pivot bars: a first pivot bar 21 and a second pivot bar 22. The frame 20 is pivotally actuated about the bar 22 by means of two operating pedal levers 23, 24. The pivot bar 22 is located in the medial main plane of the anti-drift member 11, within the latter, and is pivotally connected thereto through the medium of two substantially spherical joint balls 25, 26 inserted within the thickness of the anti-drift member. In other words, the pivot bar 22 is rigidly connected to the balls 25, 26 (between which are also mounted the operating levers 23, 24) and it is the said balls that are rotatable with respect to the anti-drift member. To allow for the movement of the transmission system 15, the anti-drift member 11 is provided with two lateral notches 28, 29 for the passage and free movement of the two arms 30, 31 of the frame 20 which rigidly interconnect the pivot bars 21 and 22. Furthermore, the said notches are surrounded with respective movement housings 32, 33 opening on the rear of the anti-drift member 11 and which are preferably relatively flat and streamlined. The said housings, the width of which depends upon the desired maximum lateral movement of the frame 20, project on either side of the anti-drift member 11 in substantially perpendicular relationship to the latter (see FIGS. 1 and 3).

Figure 7:
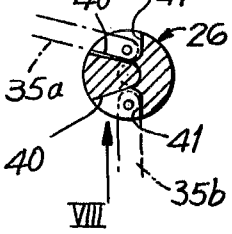
FIG. 7 is a detailed view of the ball of the spherical joint of the transmission system, shown in section upon VII—VII of FIG. 4.

Considering again the pivotal arrangement and operation of the frame 20, it is seen that each operating lever 23, 24 comprises two arms 35 extending on one and the same side of the anti-drift member from one of the balls 25 or 26, respectively, and interconnected by a curved stirrup cross-member 36 pivotally mounted therebetween. The shape and length of each curved cross-member 36 (provided with a pivotal tread or bearing plate 37) are calculated to allow the swimmer to actuate the apparatus without being compelled to remove his flippers (FIG. 1). The curved shape of the stirrup member 36, the concavity of which, directed towards the rear of the apparatus, is designed to provide a bearing point which is set back with respect to the points of pivotal connection to the arms 35, thus ensuring complete foot stability without resorting to straps. Each arm 35 is itself pivotally connected to one of the balls 25 or 26 as shown in FIG. 7. To this end, each ball is provided with two lateral slots 40 (one for each arm 35 connected thereto) in which the ends of the corresponding arms are engaged. Each slot 40 widens out towards substantially the front of the apparatus to allow the corresponding arm (35*a* in FIG. 7) to be folded to the stowing position shown in FIGS. 2 and 3. On the other hand, it is provided with a stop surface 41 substantially perpendicular to the surface of the rigid frame 20 to allow the corresponding arm to be maintained in working position (arm 35*b* in FIG. 7), i.e. with the pedals unfolded or opened out as seen in FIGS. 12 or 13.

According to an essential aspect of the invention, the propelling fish-tail member 16 can pivot substantially freely (or at least without a notable effort being required for that) about the first pivot bar 21 lengthwise of the latter and within a predetermined neutral sector or angular area which, in the case considered, is about 90 deg. (about 45 deg on either side of the plane of the frame 20). Beyond this neutral sector, the member 16 meets a stop system 50 which will be described later and which opposes further rotation. Lastly, considering the position of the pivot bar 21 within the panel which constitutes the propelling member 16, it is important to note that the position of this pivot bar is such that the rear portion 51 of the said panel (beyond the pivot bar 21 with respect to the swimmer) offers a larger surface than that of its front portion 52 (i.e. the portion of the propelling member 16 that is located between the swimmer and the pivot bar 21). This particular feature is clearly illustrated in FIG. 2 and it has been found that the ideal ratio of one surface to the other is $\frac{2}{3}$ for the rear portion and $\frac{1}{3}$ for the front portion.

Figure 11:
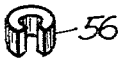
FIG. 11 is a detailed view of a mounting ring for the pivot bar of FIG. 9.

The rotary joints connecting the member 16 to the pivot bar 21 are preferably provided at each cylindrical end portion 55 of the said bar by means of split rings 56 (FIG. 11) secured to the core of the member 16 and located on either side of the points of connection between the bar 16 and the arms 30, 31.

To ensure the free movement of the propelling member 16 with respect to the pivot bar 21, the said propelling member is provided with two slots 57 opening out towards the front to allow for the passage of arms 30 and 31.

Figure 5:
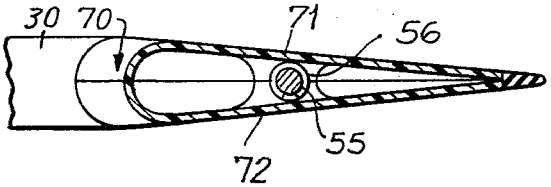
FIG. 5 is a sectional view upon V—V of FIG. 2.
Figure 10:
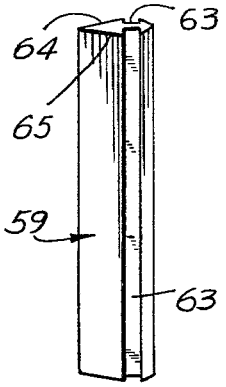
FIG. 10 is a detaild view of the aforesaid stop means.
Figure 6:
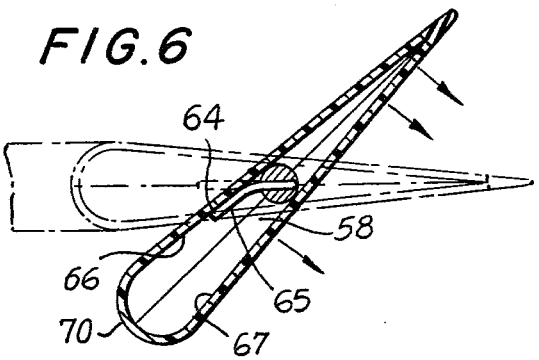
FIG. 6 is a sectional view upon VI—VI of FIG. 2, the propelling member being shown in inclined position during operation, with the position of rest of the same member being shown in phantom lines.

Furthermore, the stop means 50 is preferably resilient in order not to oppose the rotation of the propelling member 16 too sharply, but on the contrary progressively so as to avoid the stopping noise at each beat. According to a preferred form of embodiment of the invention, the propelling member has a hollow portion 58 around a major portion of the pivot bar 21 and the resilient stop means 50 is secured to this bar and entirely housed in the hollow portion 58. More precisely, the stop means is constituted by a flexible rubber block 59 tapering towards the front and retained in a longitudinal aperture 60 of the pivot bar 21, the central portion 61 of which is provided to this end with a wider section offering two mutually opposite flat surfaces onto which the said aperture opens. The rubber block or band 59 is provided on each of its faces with two mutually opposite longitudinal grooves 63 allowing it to be retained in the aperture 60 in the manner shown in FIG. 4. The flexible block being thus placed in the hollow portion 58, it is readily understood that the opposite faces 64, 65 of its tapering portion are automatically arranged to face the mutually opposite internal surfaces 66, 67 of the hollow portion 58 and to react against the said surfaces during the rotation of the propelling member. The propelling member 16 is in fact almost entirely hollow (thus contributing to the lightness of the apparatus) since it is constituted by the assembly of two identical plastics half-shells about the pivot bar 21. The propelling member as illustrated forms a relatively flat, rigid assembly, the two mutually opposite main faces 71, 72 of which form a dihedral angle, the apex of which is directed rearwards. The front edge 70 is curved and offers a shaped section, at least approximately in the form of an arc of a circle (FIGS. 5 and 6), interconnecting the faces of the dihedral angle. The ideal value of the dihedral is about 6 deg, so that when the propelling member is stopped at 45 deg in one direction or the other during a sweeping motion, the thrust angle of the active face of the dihedral repelling the water rearwards is still greater and substantially equal to 51 deg.

Figure 2:
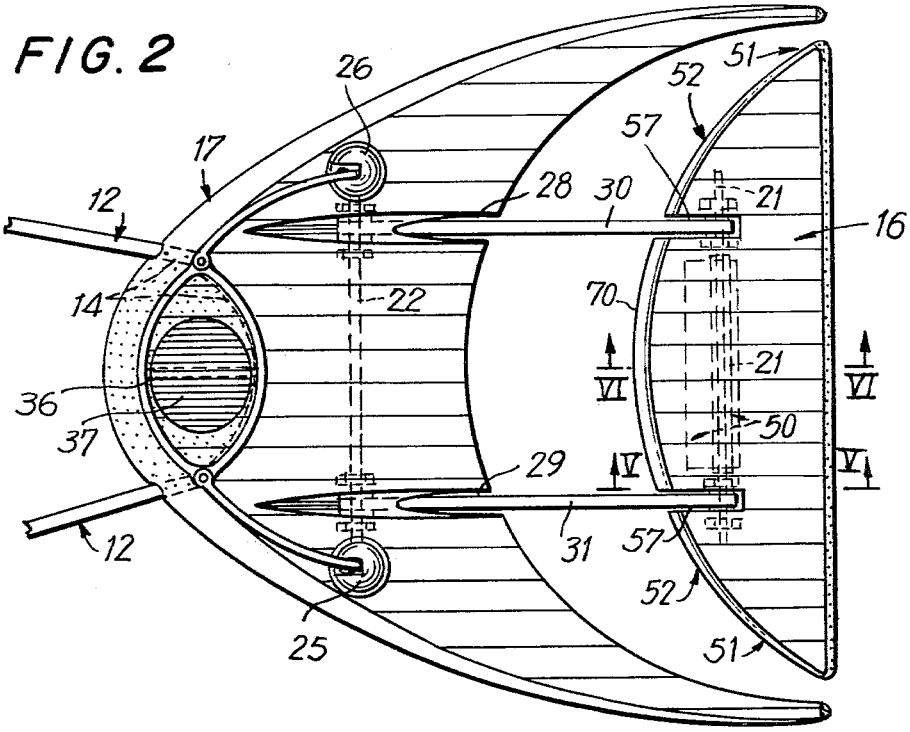
FIG. 2 is an elevational view of the apparatus shown to a larger scale with the constituent elements of the pedals folded forward in stowing position.
Figure 8:
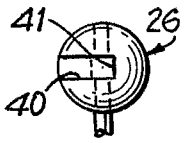
FIG. 8 is a view of the same joint-ball in the direction of arrow VIII of FIG. 7.

Additionally, as best seen in FIG. 2, the transversely extending leading edge of propelling member 16 has a curved, arcuate configuration which terminates at the end regions of the rectilinear trailing edge thereof. Of course, the trailing edge of the crescent-shaped anti-drift member 11 also has a curved arcuate configuration having a larger radius of curvature than that of the leading edge of the propelling member defining an open area immediately rearwardly thereof. Again, as clearly seen in FIG. 2, by virtue of the crescent shape of the anti-drift member and the arcuate configuration of the leading edge of the propelling member the latter is located in the rearward area defined by the trailing edge of the anti-drift member in relatively close relationship thereto.

The operation of the apparatus is obviously inferred from the foregoing description. When the user is attached to the apparatus and begins to press on one of the pedals, the propelling member is almost immediately placed at 45 deg with respect to the plane of the frame 20 owing to the greater counter-thrust exerted by the water on its rear portion 51 than on its front portion 52. Consequently, the propelling member is instantly placed in a correct position to repel the water rearwards in a highly propulsive motion and for the whole duration of the sweeping. As soon as the user starts the return sweeping motion, the propelling member sharply pivots by about 90 deg and again assumes a correct position with respect to the sweeping direction.

Moreover, the secondary swinging motions perceived in the region of the anti-drift member are considerably reduced owing to the fact that the thrust is highly efficient and serves almost exclusively to propel the apparatus. Besides, it has been found that even these secondary motions can be propulsive. Indeed, owing to its cross-sectional shape tapering towards the rear, when the propelling member tends to produce on the anti-drift member a counter-motion of lateral displacement, the said anti-drift member, owing to its special cross-sectional shape, simultaneously takes a bearing in the water, in a sliding effect directed essentially forward. Therefore, this secondary and simultaneous thrust additionally facilitates the forward movement of the apparatus.

Of course, the invention is by no means limited to the form of embodiment just described. Thus, for example, the use of a rigid propelling member is economically advantageous, but use can also be made as in the prior art of a flexible propelling member. Therefore, the invention covers all the technical equivalents of the means used if the latter are carried out within the scope of the following claims.

What is claimed is:

1. An apparatus for the self-propulsion of swimmers of the type comprising an anti-drift member, a harness set connected to the said anti-drift member and adapted to be passed round the body of the said swimmer, and at least one propelling fishtail member connected to the said anti-drift member through a transmission system so mounted as to perform a swinging or oscillating motion with respect to the said anti-drift member and actuated by the swimmer, wherein said transmission system comprises a rigid, substantially rectangular frame, one of the sides of which is constituted by a first pivot-bar substantially parallel to the main medial plane of said anti-drift member, the frame side opposite to said first pivot bar constituting a second pivot bar about which said frame pivots with respect to said anti-drift member and wherein said second pivot bar is arranged in the main medial plane of said anti-drift member and is pivotally connected to the latter by two substantially spherical joint-balls incorporated in the thickness of said anti-drift member, wherein said propelling member is arranged to substantially freely pivot about the said first pivot bar lengthwise of the latter and wherein stop means are secured to the transmission system and arranged on the pivoting path of the said propelling member about the said first pivot bar in order to oppose its rotation preferably beyond a predetermined neutral sector or angular region; and said anti-drift member is a relatively flat panel cut in the general shape of a crescent; the front edge of said propelling member being curved.

2. An apparatus according to claim 1, wherein two operating levers forming pedals are mounted between the said two joint balls on either side, respectively, of the said anti-drift member.

3. An apparatus for the self-propulsion of swimmers of the type comprising an anti-drift member, a harness set connected to the said anti-drift member and adapted to be passed round the body of the said swimmer, and at least one propelling fishtail member connected to the said anti-drift member through a transmission system so mounted as to perform a swinging or oscillating motion with respect to the said anti-drift member and actuated by the swimmer, wherein the said transmission system comprises a first pivot-bar substantially parallel to the main medial plane of the said anti-drift member, wherein said propelling member is arranged to substantially freely pivot about the said first pivot bar lengthwise of the latter, wherein stop means are secured to the transmission system and arranged on the pivoting path of the said propelling member about the said first pivot bar in order to oppose its rotation preferably beyond a predetermined neutral sector or angular region, wherein the rear portion of the said propelling member beyond the said first pivot bar has a surface greater than its front portion, wherein the said transmission system comprises a rigid, substantially rectangular frame, one of the sides of which is constituted by the said first pivot bar, the frame side opposite to the said first pivot bar constituting a second pivot bar about which the said frame pivots with respect to said anti-drift member, wherein the said second pivot bar is arranged in the medial main plane of the said anti-drift member and is pivotally connected to the latter through the medium of two substantially spherical joint-balls incorporated in the thickness of the said anti-drift member, wherein two operating levers forming pedals are mounted between the said two joint balls on either side, respectively, of the said anti-drift member, and wherein each said operating lever is constituted by two arms extending on one and the same side of the said anti-drift member from the said joint balls, respectively, a curved stirrup cross-member being pivotally mounted between the ends of the said two arms.

4. An apparatus according to claim 3, wherein the said propelling member forms a rigid, relatively flat unit, the two opposite main faces of which form a dihedral angle, the apex of which is directed rearwards, the front edge of the said propelling member being curved and with a section shaped at least approximately as an arc of a circle interconnecting the said two opposite main faces.

5. An apparatus according to claim 4, wherein the value of the said dihedral angle is approximately 6 deg.

6. An apparatus according to claim 1, wherein the said anti-drift member is a relatively flat panel cut in the general shape of a crescent with a cross-section tapering towards the rear, the front edge of the said panel having at all points a shaped convex leading section.

7. An apparatus according to claim 3, wherein each arm is pivotally connected to the corresponding joint-ball, the end of the said arm being inserted in a lateral slot provided in the said joint-ball.

8. An apparatus according to claim 7, wherein the slot of the said joint-ball is flared substantially towards the front of the said apparatus to allow the corresponding arm to be folded into stowing position and that it also provides a stop or abutment surface substantially perpendicular to the surface of the said frame to allow the said corresponding arm to be retained in working position.

9. An apparatus according to claim 3, wherein the curvature of the said stirrup cross-member has its concavity directed towards the rear when the said operating lever is in working position.

10. An apparatus for the self-propulsion of swimmers of the type comprising an anti-drift member, a harness set connected to the said anti-drift member and adapted to be passed round the body of the said swimmer, and at least one propelling fishtail member connected to the said anti-drift member through a transmission system so mounted as to perform a swinging or oscillating motion with respect to the said anti-drift member and actuated by the swimmer, wherein the said transmission system comprises a first pivot-bar substantially parallel to the main medial plane of the said anti-drift member, wherein said propelling member is arranged to substantially freely pivot about the said first pivot bar lengthwise of the latter, wherein stop means are secured to the transmission system and arranged on the pivoting path of the said propelling member about the said first pivot bar in order to oppose its rotation preferably beyond a predetermined neutral sector or angular region, wherein the rear portion of the said propelling member beyond the said first pivot bar has a surface greater than its front portion, wherein the said transmission system comprises a rigid, substantially rectangular frame, one of the sides of which is constituted by the said first pivot bar, the frame side opposite to the said first pivot bar constituting a second pivot bar about which the said frame pivots with respect to said anti-drift member, wherein the said second pivot bar is arranged in the medial main plane of the said anti-drift member and is pivotally connected to the latter through the medium of two substantially spherical joint-balls incorporated in the thickness of the said anti-drift member, wherein the said anti-drift member is provided with two lateral notches for the passage and free angular movement of both arms of the said frame interconnecting the said pivot bars and that the said notches are preferably surrounded with respective housings or enclosures allowing for the said movement, opening towards the rear and preferably relatively flat and streamlined, the said housings or enclosures projecting on either side of the said anti-drift member in substantially perpendicular relationship thereto.

11. An apparatus for the self-propulsion of swimmers of the type comprising an anti-drift member, a harness set connected to the said anti-drift member and adapted to be passed round the body of the said swimmer, and at least one propelling fishtail member connected to the said anti-drift member through a transmission system so mounted as to perform a swinging or oscillating motion with respect to the said anti-drift member and actuated by the swimmer, wherein the said transmission system comprises a first pivot-bar substantially parallel to the main medial plane of the said anti-drift member, wherein said propelling member is arranged to substantially freely pivot about the said first pivot bar lengthwise of the latter, wherein stop means are secured to the transmission system and arranged on the pivoting path of the said propelling member about the said first pivot bar in order to oppose its rotation preferably beyond a predetermined neutral sector or angular region, wherein the rear portion of the said propelling member beyond the said first pivot bar has a surface greater than its front portion, and wherein the said propelling means comprises a hollow portion through which the said first pivot bar passes and that the stop means are secured to the said first pivot bar and housed in the said hollow portion, and wherein said stop means are constituted by a flexible band or block, advantageously of rubber or like material, of tapering cross-section, retained in a longitudinal aperture of the said first pivot bar, the tapering or narrowest portion of the said flexible band or block projecting from the said first pivot bar and being so arranged that its opposite faces are in confronting relationship to the opposite internal faces of the said hollow portion.

12. An apparatus according to claim 11, wherein the said pivot bar comprises a central portion of wider cross-section having two opposite flat surfaces onto which the said aperture opens and that the said central portion is prolonged at each end by portions of circular cross-section to which the said propelling member is pivotally connected.

13. An apparatus according to claim 11, wherein the said flexible band or block is provided with two opposite longitudinal grooves extending on each face thereof, respectively, and constituting a means of retaining the said flexible band or block in the said aperture.

* * * * *